US006647593B2

(12) United States Patent
Iguchi et al.

(10) Patent No.: US 6,647,593 B2
(45) Date of Patent: Nov. 18, 2003

(54) HINGE UNIT OF MOUNTING STRAP

(75) Inventors: Katsunobu Iguchi, Chiba (JP); Takashi Ito, Chiba (JP)

(73) Assignee: Seiko Instruments Inc., Chiba (JP)

( * ) Notice: Subject to any disclaimer, the term of this patent is extended or adjusted under 35 U.S.C. 154(b) by 0 days.

(21) Appl. No.: 10/001,336

(22) Filed: Oct. 26, 2001

(65) Prior Publication Data

US 2002/0104192 A1 Aug. 8, 2002

(51) Int. Cl.[7] ..... E05D 5/16

(52) U.S. Cl. ..... 16/386; 16/278; 16/348; 74/89; 74/56; 403/166

(58) Field of Search ..... 16/386, 278, 279, 16/348, 378, 297; 74/89, 56; 403/166

(56) References Cited

U.S. PATENT DOCUMENTS

| | | | | | |
|---|---|---|---|---|---|
| 353,007 | A | * | 11/1886 | Schubert et al. | 16/381 |
| 1,200,538 | A | * | 10/1916 | smtih et al. | 16/303 |
| 1,470,687 | A | * | 10/1923 | Clarke | 451/117 |
| 2,186,789 | A | * | 1/1940 | Rosenberg | 16/229 |
| 2,457,251 | A | * | 12/1948 | Main | 137/599.02 |
| 2,765,108 | A | * | 10/1956 | Doerwald | 224/174 |
| 3,919,890 | A | * | 11/1975 | Workman | 74/89 |
| 4,419,770 | A | | 12/1983 | Yagi et al. | |
| 4,564,308 | A | * | 1/1986 | Ikegami et al. | 403/166 |
| 4,788,746 | A | * | 12/1988 | Idler | 16/297 |
| 4,935,996 | A | * | 6/1990 | Ferrara | 24/598.1 |
| 5,251,189 | A | | 10/1993 | Thorp | |
| 6,070,293 | A | * | 6/2000 | Schreiber | 16/229 |
| 6,158,725 | A | * | 12/2000 | Fischer | 267/168 |

FOREIGN PATENT DOCUMENTS

| | | |
|---|---|---|
| EP | 0494584 | 7/1992 |

* cited by examiner

*Primary Examiner*—Gary Estremsky
*Assistant Examiner*—Mark Williams
(74) *Attorney, Agent, or Firm*—Adams & Wilks

(57) ABSTRACT

A hinge assembly has a tubular member having a longitudinal axis, a peripheral surface, and a slot formed in the peripheral surface. A button member extends into the tubular member to undergo sliding movement in an axial direction along the longitudinal axis of the tubular member and to undergo rotational movement relative to the tubular member. A pin member is connected to the button member and extends into the slot of the tubular member to undergo movement therein during sliding and rotational movement of the button member relative to the tubular member. The button member is biased in a preselected direction of rotation relative to the tubular member by a first biasing member. The button member is biased in an axial direction by a second biasing member.

27 Claims, 9 Drawing Sheets

HINGE UNIT OF MOUNTING STRAP

BACKGROUND OF THE INVENTION

1. Field of the Invention

The present invention relates to a hinge assembly having at least one hinge unit of a mounting strap for use with a portable information apparatus.

2. Description of the Prior Art

Generally, as a mounting strap for mounting a wrist watch or a portable apparatus such as a wrist watch type communication apparatus or a wrist watch type information apparatus represented by a PHS (Personal Handyphone System) communication terminal onto the arm, there is known, for example, a mounting strap mounted onto the arm by connecting together two pieces of a 6 o'clock side strap and a 12 o'clock side strap connected to two opposed ends (hereinafter, referred to as "6 o'clock side" and "12 o'clock side") of a case main body of a portable apparatus by locking thereof by buckles. Herein, such a type strap is referred to as a strap of a buckle type. There is known a strap of the buckle type made of skin or made of fiber having buckles or made by a metal chain having bindings.

Further, other than the strap of the buckle type, there is known a strap of a bangle type formed in a predetermined shape capable of surrounding the arm by a 6 o'clock side strap and a 12 o'clock side strap. The strap of the bangle type is mounted onto the arm by fixing the strap in a state of being fitted to pinch the arm without connecting together the 6 o'clock side strap and the 12 o'clock side strap. There is constructed a structure in which in opening and closing the strap of the bangle type, when the strap is detached in a state of being fitted to the arm, the 6 o'clock side strap or the 12 o'clock side strap is pulled to open directly by force of the hand of a user, further, when the strap is fitted thereto in an opened state, the 6 o'clock side strap or the 12 o'clock side strap is pushed to close directly by the force of the hand of the user.

However, according to the above-described conventional mounting strap of the buckle type, the 6 o'clock side strap and the 12 o'clock side strap are connected together by the buckles and locked to prevent from being readily detached and firmly fitted to the arm and therefore, the operability in attaching and detaching thereof is poor. Further, even in the case of the mounting strap of the bangle type referred to also as a bracelet type, there poses a problem that the opening and closing operation is carried out directly by the force of the hand of the user per se and therefore, the operability in attaching and detaching thereof is poor.

SUMMARY OF THE INVENTION

Hence, the invention has been carried out in view of the above-described drawbacks in the conventional art and it is an object thereof to provide a hinge unit for opening or closing a mounting strap of a bangle type facilitating attaching and detaching thereof and having an excellent fitting feeling.

In order to achieve the above-described object, according to an aspect of the invention, there is provided a hinge unit of a mounting strap characterized in comprising a rotational pipe member formed with a hole in an L-like shape perforated in the L-like shape toward a peripheral direction and an axial direction at a side face thereof, a button member inserted to the rotational pipe member, a fixed member projected and inserted into the hole in the L-like shape of the rotational pipe member and connected to the button member, an axial direction elastic member for urging the rotational pipe member and the button member to each other such that the fixed member is butted to a side of a terminal end in the axial direction of the hole in the L-like shape of the rotational pipe member, and a rotational direction elastic member for urging the rotational pipe member and the button member to each other such that the fixed member is butted to a side of a terminal end in a peripheral direction of the hole in the L-like shape of the rotational pipe member, wherein either one of the rotational pipe member and the fixed member is attached to a case main body of a portable apparatus and other thereof is attached to a strap piece to thereby axially fix the strap piece rotatably to one end side or other end side of the case main body.

Thereby, as described later, by axially fixing the strap piece rotatably to the one end side or the other end side of the case main body, the user can detach the mounting strap from the arm and mount the mounting strap thereto by operation of pushing the button member.

According to another aspect of the invention, there is provided a hinge unit of a mounting strap characterized in comprising a rotational pipe member formed with a hole in an L-like shape perforated in the L-like shape in a peripheral direction and an axial direction at a side face thereof, a slide pipe member inserted to the rotational pipe member and formed with a long hole perforated to direct skewedly relative to the axial direction at a side face thereof, a button member inserted into the slide pipe member, a fixed member projected and inserted to the hole in the L-like shape of the rotational pipe member and the long hole of the slide pipe member and connected to the button member, an adjusting mechanism for adjusting a range of rotating the rotational pipe member relative to the slide pipe member by changing a length of the slide pipe member relative to the rotational pipe member, an axial direction elastic member for urging the slide pipe member and the button member to each other such that the fixed member is butted to a side of a terminal end in the axial direction of the hole in the L-like shape of the rotational pipe member, and a rotational direction elastic member for urging the rotational pipe member and the slide pipe member to each other such that the fixed member is butted to a side of the terminal end in the peripheral direction of the hole in the L-like shape of the rotational pipe member, wherein either of the rotational pipe member and the fixed member is attached to a case main body of a portable apparatus and other thereof is attached to a strap piece to thereby axially fix the strap piece rotatably to one end side or other end side of the case main body.

Thereby, as described later, by axially fixing the strap piece rotatably to the one end side or the other end side of the case main body, a user can detach the mounting strap from the arm and mount the mounting strap thereto by operation of pushing the button member.

Further, the fixed member is regulated not only by the hole in the L-like shape of the rotational pipe member but also by the long hole of the slide pipe member and therefore, when a length of the slide pipe member relative to the rotational pipe member is adjusted, in accordance with a pitch of the long hole, the range of rotating the rotational pipe member is changed and a ring diameter formed by the mounting strap can finely be adjusted.

Further, according to the hinge unit of the mounting strap of the invention, when the fixed member is butted to a side of a terminal end in the axial direction of the hole in the L-like shape, the strap piece is axially fixed rotatably to the one end side or the other end side of the case main body such that the mounting strap is stabilized in a state of being closed.

Thereby, when the button member is pushed into the rotational pipe member (or the slide pipe member) until the fixed member is butted to a portion intersected with the axial direction and peripheral direction of the hole in the L-like shape, the button member is slid to a side of a terminal end in the peripheral direction of the hole in the L-like shape by urge force by the rotational direction elastic member and the rotational pipe member is rotated relative to the button member to thereby rotate the strap piece in an opening direction relative to the case main body. Therefore, the user can detach the mounting strap by one touch operation since the strap piece can be opened by operation of pushing the button member.

Further, according to the hinge unit of the mounting strap of the invention, when the fixed member is butted to the side of the terminal end in the axial direction of the hole in the L-like shape, the strap piece is axially fixed rotatably to the one end side or the other end side such that the mounting strap is stabilized in a state of being opened.

Thereby, when the button member is pushed into the rotational pipe member (or the slide pipe member) until the fixed member is butted to the portion intersected with the axial direction and the peripheral direction of the hole in the L-like shape, the button member is slid to the side of the terminal end in the peripheral direction of the hole in the L-like shape by urge force of the rotational direction elastic member to thereby rotate the strap piece in the direction of being closed relative to the case main body. Therefore, the user can attach the mounting strap to the arm by one touch operation since the strap piece can be closed by operation of pushing the button member.

Further, a stepped portion may be formed at the terminal end in the axial direction of the hole in the L-like shape and the fixed member may be fitted to the stepped portion.

Further, it is preferable to provide a button bar for bridging the respective button members of the hinge unit axially fixed to the one end side of the case main body of the portable apparatus and the hinge unit axially fixed to the other end side to thereby connect each other. Thereby, the hinge units at the both ends can simultaneously be operated and therefore, attaching and detaching by one touch operation is facilitated.

The hole in the above-described L-like shape is provided when the rotational pipe member is viewed from an outer side thereof and there is included also a Γ-like shape constituting a shape of a mirror image thereof. The hinge unit can correspond to either of one touch release and one touch mounting by a difference of the L-like shape and the Γ-like shape. Further, the hinge unit can deal with either of one touch release and one touch mounting by attaching the hinge unit by changing a direction of axial fixing by 180.

Further, it is preferable to mold the strap piece in a bow-like shape by injection molding since a feeling of fitting to the arm is promoted. Further, the shape is not limited to the bow-like shape so far as the shape is the shape capable of surrounding the arm in a ring-like shape.

BRIEF DESCRIPTION OF THE DRAWINGS

A preferred form of the present invention is illustrated in the accompanying drawings in which.

DETAILED DESCRIPTION OF THE PREFERRED EMBODIMENTS

A detailed explanation will be given of the invention with reference to the drawings as follows. Further, the invention is not limited by the embodiments described herein. Further, an explanation will be given of the embodiments by taking an example of a mounting strap used for a PHS (Personal Handyphone System) communication terminal of a wrist watch type communication apparatus.

(Embodiment 1)

Figure 1:
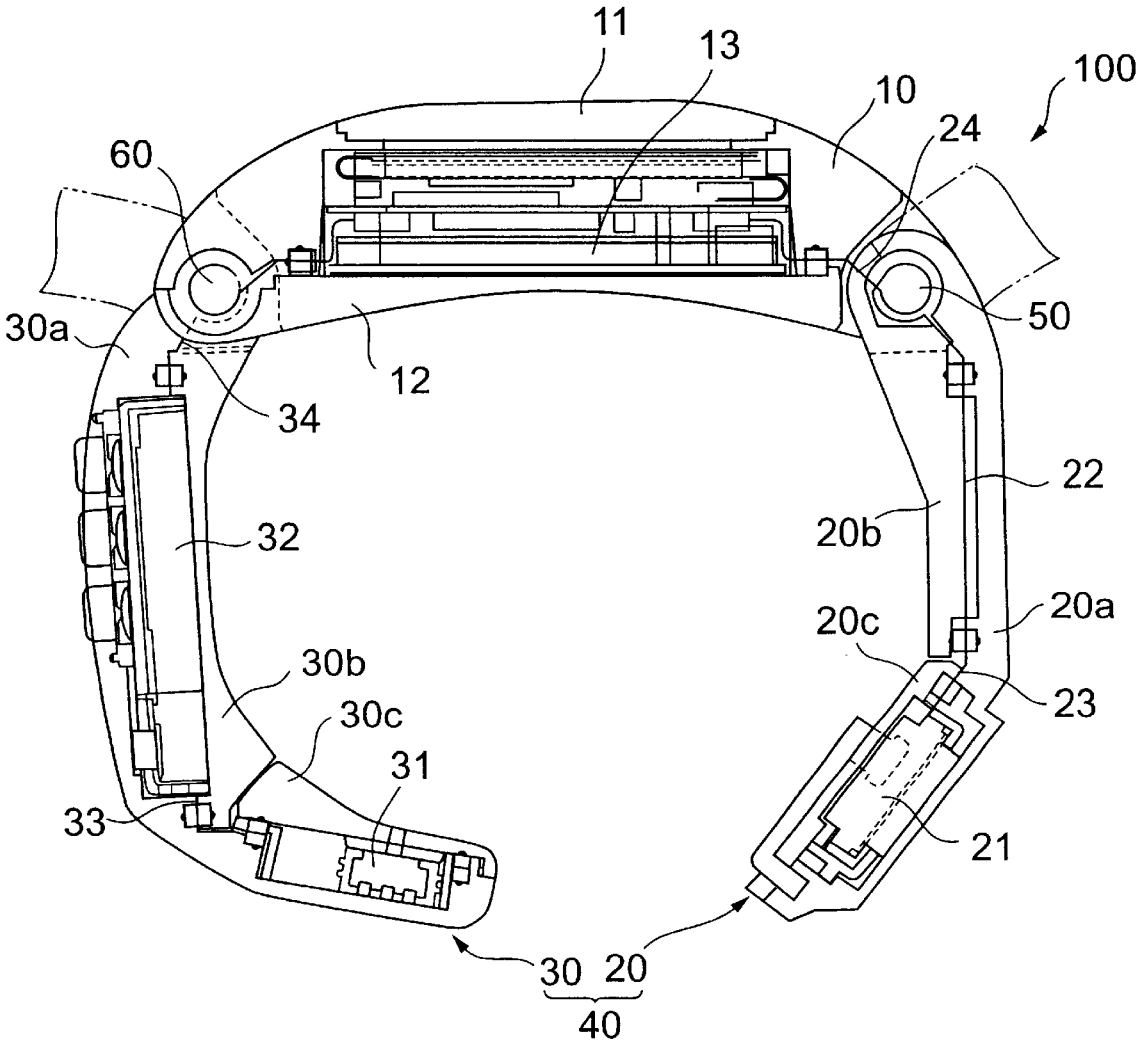
FIG. 1 is a sectional view of a wrist watch type PHS communication terminal according to Embodiment 1 of the invention.

FIG. 1 is a sectional view of a wrist watch type PHS communication terminal showing Embodiment 1 of the invention. The wrist watch type PHS communication terminal 100 is constituted by a case main body 10 and a mounting strap 40 in a ring-like shape comprising a 12 o'clock side strap 20 in a bow-like shape rotatably attached to the case main body 10 on a 12 o'clock side of the case main body 10 and a 6 o'clock side strap 30 in a bow-like shape rotatably attached to the case main body 10 on a 6 o'clock side of the case main body 10.

The case main body 10 includes a PHS communication unit 13 comprising electronic parts for carrying out PHS communication such as an antenna, a battery and a display panel in a space hermetically closed by a glass member 11 for protecting a display panel attached on a surface side and a case back 12 attached to a rear face side thereof. The 12 o'clock side strap 20 is formed in the bow-like shape by integrating an upper strap 20*a* and lower straps 20*b* and 20*c* and includes a speaker 21, a sheet board 22 and wirings 23 and 24 for electrically connecting these to the PHS communication unit 13.

Further, the 10 o'clock side strap 20 is axially supported rotatably relative to the case main body 10 by a hinge assembly having a pipe hinge unit 50, urged to rotate from a closed state indicated by bold lines to an opened state indicated by two-dotted chain lines and is fixed to maintain the closed state indicated by the bold lines. Further, as described later, the wrist watch type PHS communication terminal 100 can be detached from the arm by bringing the 12 o'clock side strap 20 from the closed state to the opened state by one touch operation of the pipe hinge unit 50.

Meanwhile, the 6 o'clock side strap 30 is formed in the bow-like shape by integrating an upper strap 30*a* and lower straps 30*b* and 30*c* and includes a microphone 31, an operational button unit 32 and wirings 33 and 34 for electrically connecting these to the PHS communication unit 13. Further, similarly, the 6 o'clock side strap 30 is axially supported rotatably relative to the case main body 10 by a pipe hinge unit 60 of the hinge assembly, urged to rotate from a closed state indicated by bold lines to an opened state indicated by two-dotted chain lines and fixed to maintain the closed stated indicated by the bold lines. Further, as described later, the wrist watch type PHS communication terminal 100 can be detached from the arm by bringing the 6 o'clock side strap 30 from the closed state to the opened state by one touch operation of the pipe hinge unit 60.

Figure 2:
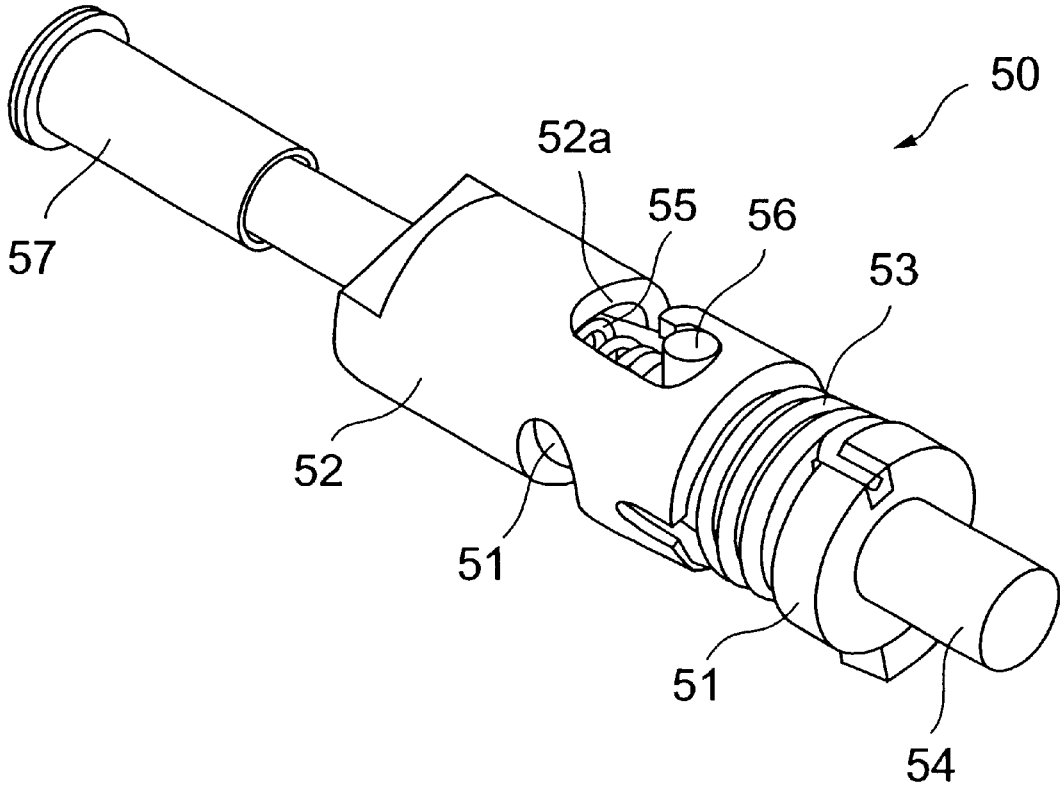
FIG. 2 is a perspective view for explaining a pipe hinge unit according to Embodiment 1 of the invention.
Figure 3:
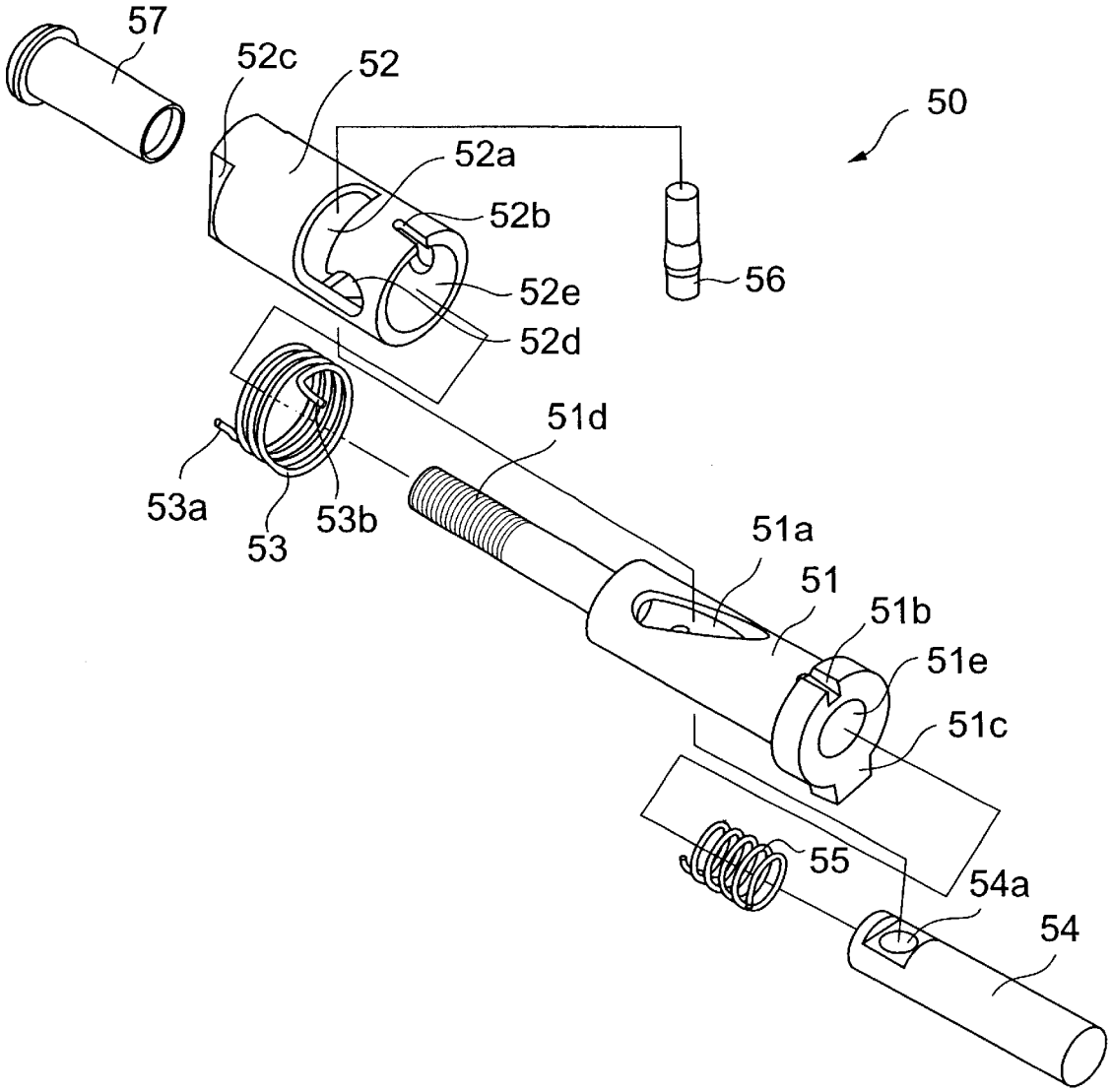
FIG. 3 is a disassembled perspective view for explaining an assembled state of the pipe hinge unit according to Embodiment 1 of the invention.

Next, an explanation will be given of the structure of the pipe hinge unit 50. Further, the same structure applies to the pipe hinge unit 60. FIG. 2 is a perspective view for explaining the pipe hinge unit according to Embodiment 1 of the invention. FIG. 3 is a disassembled perspective view showing an assembled state of the pipe hinge unit according to Embodiment 1 of the invention. As shown by FIG. 2 or FIG. 3, the pipe hinge unit 50 comprises respective parts of a slide pipe 51, a rotational tubular member 52 (hereinafter "rotational pipe"), a pipe return spring 53 constituting a first biasing member, a button 54, a button extracting spring 55 constituting a second biasing member, a fixed pin 56 and a unit fixing screw 57.

The slide pipe 51 is formed in a shape integrated with a hollow member one end side of which is opened and a rod-like member formed at other end side of the hollow member and, is formed with a fixed pin slide hole 51*a*, a pipe return spring engaging groove 51*b*, a case inserting portion 51*c*, a slide pipe drawing screw portion 51*d*, a hollow hole portion 51*e* and a fixed pin regulating face 51*f*, mentioned later. The fixed pin slide hole 51*a* is a hole formed at a peripheral face of the hollow member skewedly relative to the axial direction (spirally) with a width by which the fixed pin 56 can be inserted and is a hole through which the fixed pin 56 slides when the slide pipe 51 per se is rotated. That is, when the fixed pin 56 is fixed, rotation of the slide pipe 51 is regulated by the fixed pin 56.

The pipe return spring engaging groove 51*b* is inserted with a slide pipe inserting bent portion 53*b* of the pipe return spring 53. The case inserting portion 51*c* is inserted into a side of the case main body 10, mentioned later. The slide pipe drawing screw portion 51*d* is screwed with the unit fixing screw 57. The hollow hole portion 51*e* is inserted with the button 54.

The rotational pipe 52 is a pipe both ends of which are opened and is formed with a fixed pin slide slot or hole 52*a*, a pipe return spring engaging groove 52*b* forming a longitudinal extension of the fixed pin slide hole 52*a*, a strap regulating portion 52*c*, a fixed pin settling stepped portion 52*d* and a hollow hole portion 52*e*. The fixed pin slide hole 52*a* is a hole formed in an L-like shape at a peripheral face of the rotational pipe 52 with a width by which the fixed pin 56 can be inserted. The pipe return spring engaging groove 52*b* is inserted with a rotational pipe inserting bent portion 53*a* of the pipe return spring 53. The strap regulating face portion 52*c* is brought into contact with an end face of a strap to thereby regulate rotation of the strap, as mentioned later.

The fixed pin settling stepped portion 52*d* is a portion provided by recessing one end side of the fixed pin slide hole 52*a* extended in the axial direction of the rotational pipe 52 and is a portion fitted with the fixed pin 56 to thereby prevent the rotational pipe 52 and the slide pipe 51 from being rotated, as mentioned later. The hollow hole portion 52*e* is inserted with the slide pipe 51 from one end side and inserted with the unit fixing screw 57 from other end side thereof.

The pipe return spring 53 is a spring in a helical shape formed with the rotational pipe inserting bent portion 53*a* and the slide pipe inserting bent portion 53*b*, however, the pipe return spring 53 is not limited to the helical spring but may be, for example, rubber so far as the portion is constituted by an elastic member exerting urge force operated between the slide pipe 51 and the rotational pipe 52 respectively in the rotational direction. The pipe return spring 53 is integrated between the rotational pipe 52 and the slide pipe 51 inserted into the rotational pipe 52. The rotational pipe inserting bent portion 53*a* of the pipe return spring 53 is inserted into the pipe return spring engaging groove 52*b* and another member of the slide pipe inserting bent portion 53*b* thereof is inserted into the pipe return spring engaging groove 51*b*. Thereby, when the slide pipe 51 is rotated and fixed and the rotational pipe 52 is rotated, reaction force is operated.

The button 54 is formed with a fixed pin fixing hole 54*a*. The fixed pin fixing hole 54*a* is a hole fitted with the fixed pin 56 in a state in which the button 54 is inserted into the hollow hole portion 51*e* of the slide pipe 51. Under this state, the fixed pin 56 is inserted into the fixed pin slide hole 51*a* and the fixed pin slide hole 52*a* and the button 54 is made movable in the axial direction in a range of not being disengaged from the slide pipe 51 by regulating the fixed pin 56 by the fixed pin slide hole 51*a*.

Further, movement of the fixed pin 56 is regulated also by the fixed pin slide hole 52*a* and accordingly, movement of the button 54 relative to the rotational pipe 52 is regulated by the fixed pin settling stepped portion 52*d*.

The button extracting spring 55 is a helical spring inserted into the depth side of the hollow hole portion 51*e* for exerting urge force directed to an outer side relative to the button 54. Also the button extracting spring 55 is not limited to the helical spring but may be, for example, rubber so far as the portion is an elastic member exerting the urge force directed to the outer side relative to the button 54. The fixed pin 56 regulates rotation of the slide pipe 51 and the rotational pipe 52. The unit fixing screw 57 is attached to make the slide pipe 51 and the rotational pipe 52 rotatable to each other.

Figure 4:
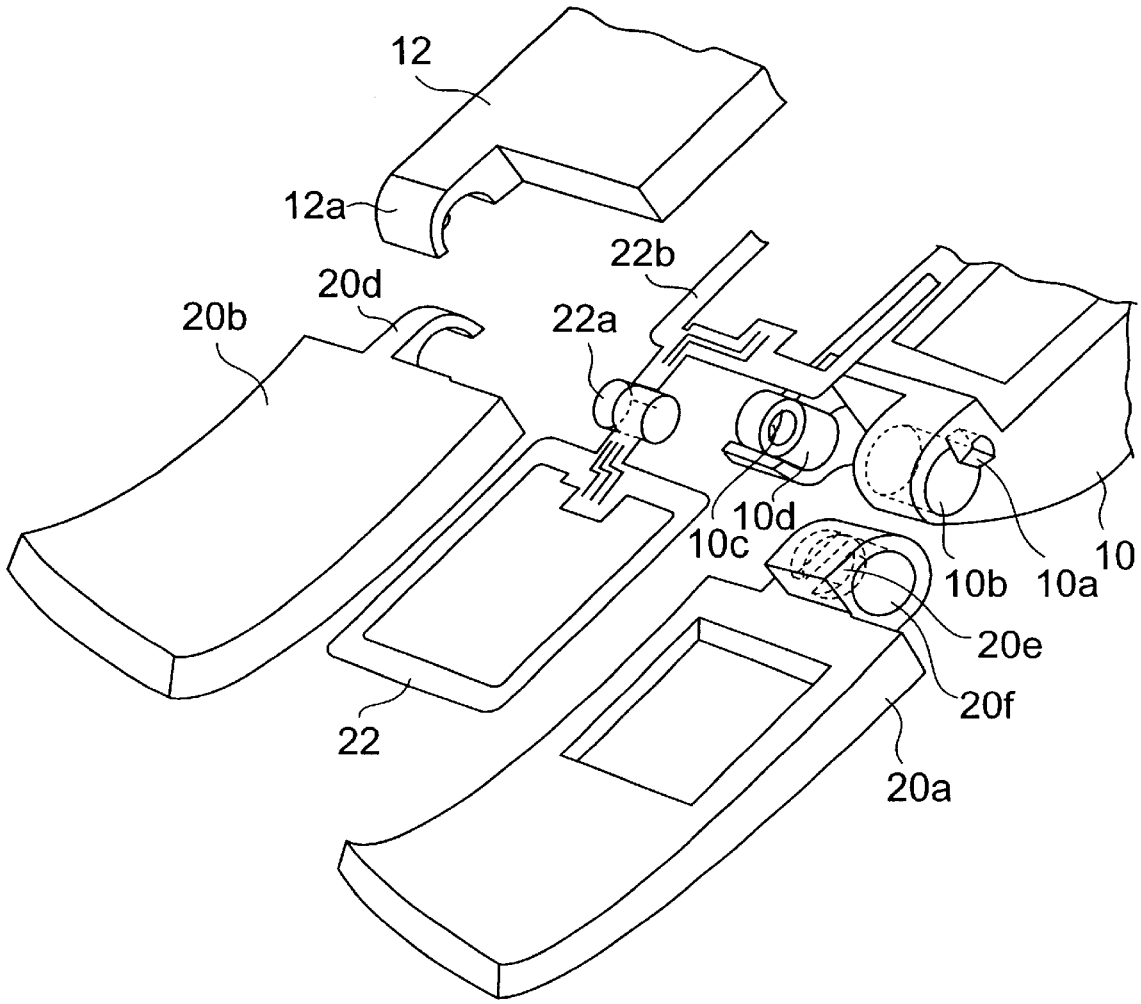
FIG. 4 is a disassembled perspective view for explaining development of a connecting portion of a case main body according to Embodiment 1 of the invention.

Next, an explanation will be given of a portion for connecting the case main body 10 and the 12 o'clock side strap 20. FIG. 4 is a disassembled perspective view for explaining the portion of connecting the case main body according to Embodiment 1 of the invention. In the case main body 10, a recessed groove portion 10*a* is formed at inside of an inserting hole 10*b* for inserting the pipe hinge unit 50, an inserting hole 10*c* is formed coaxially with the inserting hole 10*b* and a curved face portion 10*d* is formed on a side of the inserting hole 10*c*.

Further, the case back 12 is formed with a hook portion 12*a* forming a curved face. Similarly, the lower strap 20*b* is also formed with a hook portion 20*d* forming a curved face. The hook portions 12*a* and 20*d* constitute one inserting hole in a state of being integrated with the inserting hole 10*c* and the curved face portion 10*d*. Further, the upper strap 20*a* is formed with a projected portion 20*e* at inside of an inserting hole 20*f* for inserting the pipe hinge unit 50. The sheet board 22 is connected to a sheet board 22*b* on a side of the case main body 10 by interposing a cylindrical member 22*a* therebetween. The cylindrical member 22*a* is sandwiched at a portion surrounded by the curved face portion 10*d* and the hook portions 12*a* and 20*d*.

Figure 5:
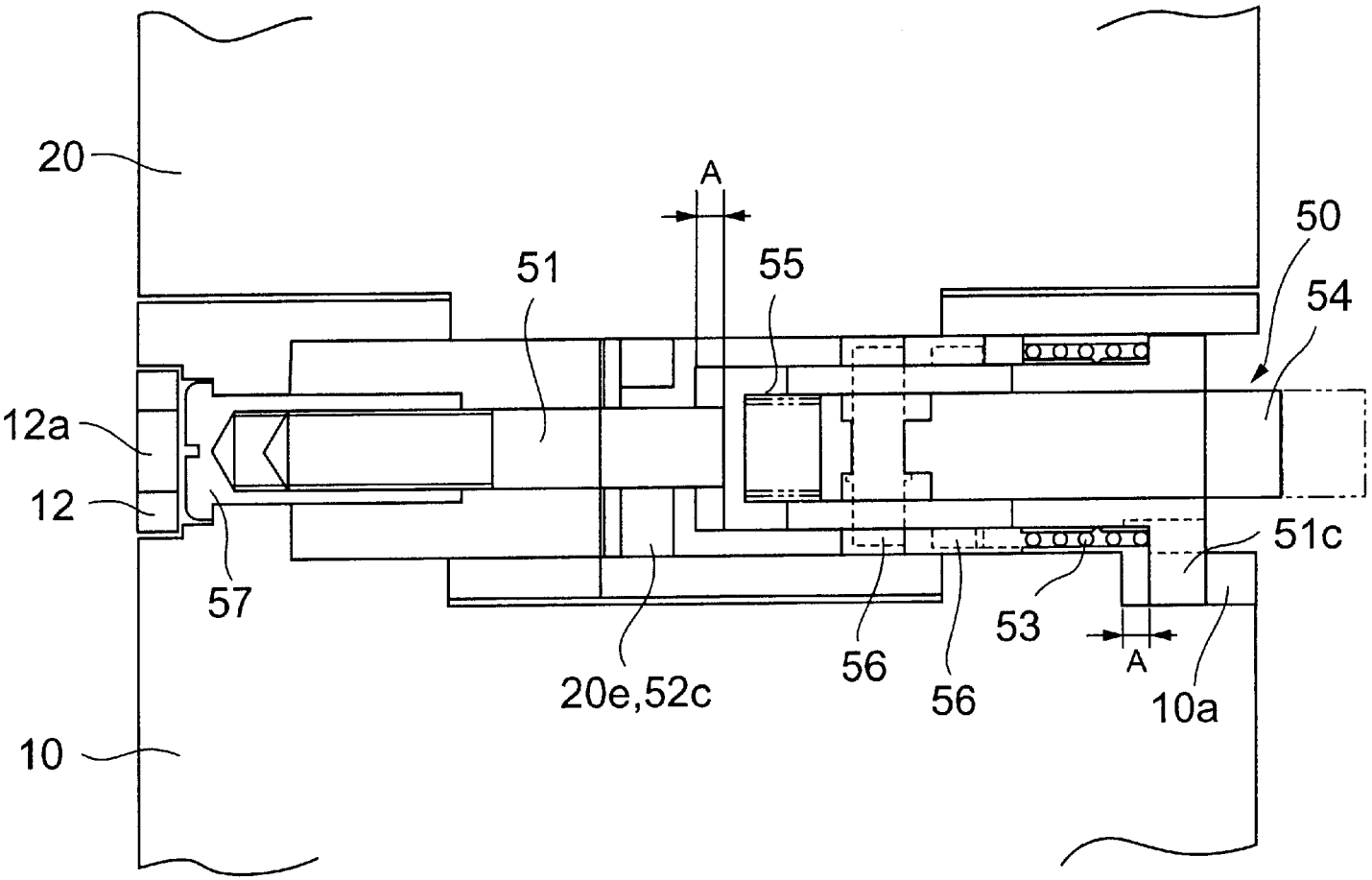
FIG. 5 is a sectional view for explaining the portion of connecting the case main body and a 12 o'clock side strap according to Embodiment 1 of the invention.

FIG. 5 is a sectional view for explaining the portion of connecting the case main body and the 12 o'clock side strap according to Embodiment 1 of the invention. The pipe hinge unit 50 is inserted and axially fixed to connect the case main body 10 and the 12 o'clock side strap 20. That is, the pipe hinge unit 50 is axially fixed by coupling the strap regulating portion (rotation regulating portion) 52*c* of the rotational pipe 51 with the projected portion 20*e* (upper strap 20*a*) and inserting the case inserting portion (projection) 51*c* of the slide pipe 51 into the recessed groove portion 10*a* of the case main body 10.

Next, an explanation will be given of operational states of the pipe hinge unit having the above-described constitution in opening and closing the strap. FIG. 6, FIG. 7, FIG. 8 and FIG. 9 are perspective views for explaining operational states of the pipe hinge unit according to Embodiment 1 of the invention. Further, in the following explanation, FIG. 5 is pertinently referred to.

Figure 6:
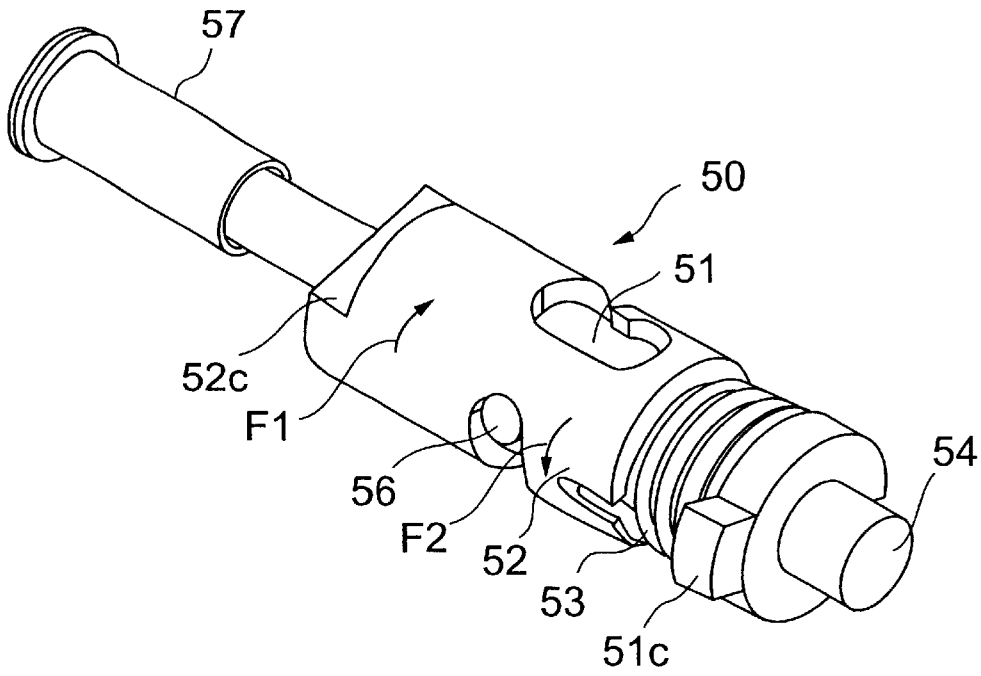
FIG. 6 is a perspective view for explaining an operational state of the pipe hinge unit according to Embodiment 1 of the invention.

First, when the strap is closed from the state in which the strap is opened (in FIG. 1, the 12 o'clock side strap 20 (6 o'clock side strap 30) is brought from the state indicated by the two-dotted chain lines to the state indicated by the bold lines), as shown by an operational state view of FIG. 6, rotation of the slide pipe 51 relative to the case main body 10 is regulated by fitting the case inserting portion 51*c* to the recessed groove portion 10*a*, further, since the slide pipe 51 is fixed by the projected portion 20*e* and the strap regulating portion 52*c*, when the rotational pipe 52 is rotated by force F1, there is brought about a state in which reaction by the pipe return spring 53 is operated.

Figure 7:
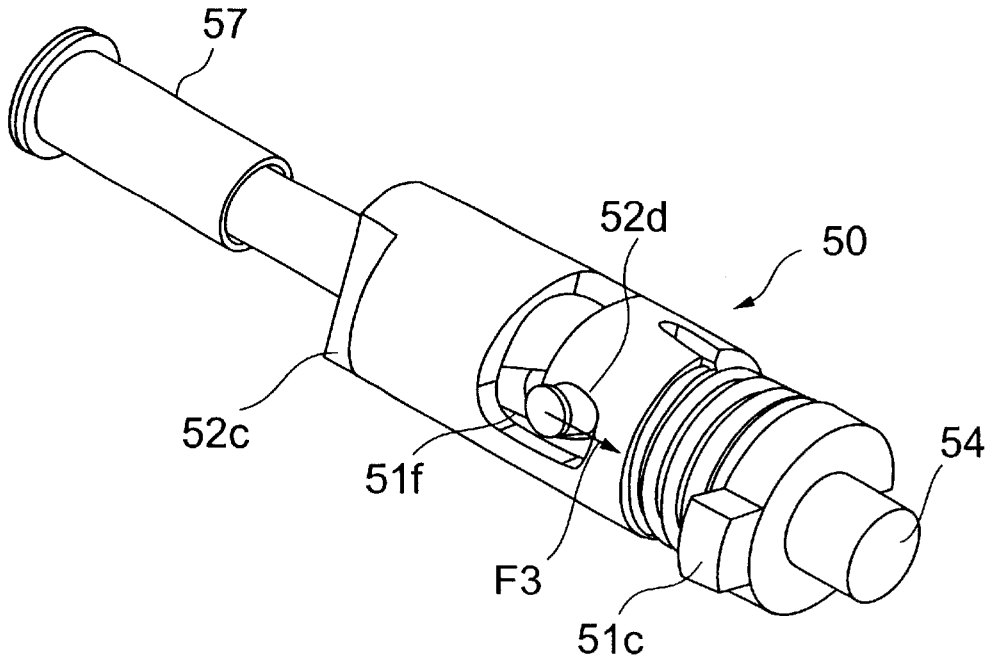
FIG. 7 is a perspective view for explaining an operational state of the pipe hinge unit according to Embodiment 1 of the invention.

At this occasion, when the rotational pipe 52 is further rotated and reaches a state shown by FIG. 7, since the button 54 having the fixed pin 56 integrated to inside of the slide pipe 51, is exerted with force F3 by the button extracting spring 55, there is brought about a state in which the fixed pin 56 starts to enter the fixed pin slide hole 52*a* in the L-like shape of the rotational pipe 52 in the axial direction. Then, the fixed pin 56 is brought into a state of being sandwiched between the fixed pin regulating face (wall face) 51*f* of the slide pipe 51 and the fixed pin settling stepped portion (wall face) 52*d* of the rotational pipe 52 and there is brought about a state shown by FIG. 8 in which even force of closing the strap is released, the strap is held.

Figure 8:
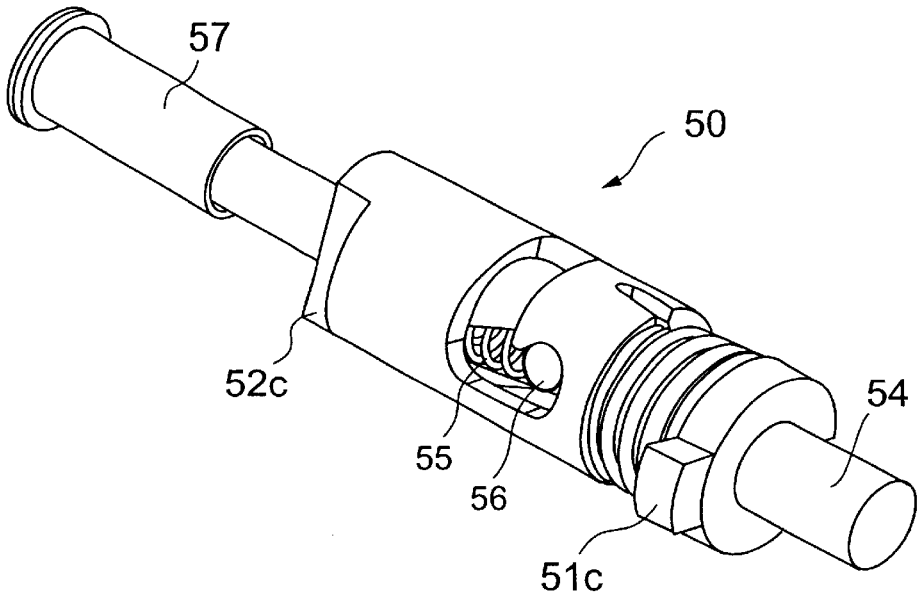
FIG. 8 is a perspective view for explaining an operational state of the pipe hinge unit according to Embodiment 1 of the invention.

Conversely, with regard to a mechanism for detaching the strap, the state shown in FIG. 8 is brought into the state shown by FIG. 7 and the state shown by FIG. 6 finally. That is, by pushing in the button 54, the fixed pin 56 rides over the fixed pin settling stepped portion (groove) 52*d*, the fixed pin 56 and the rotational pipe 52 are separated from each other and the rotational pipe 52 is rotated by the strap return spring 53 having reaction force. Thereby, the strap can be detached from the arm.

Figure 9:
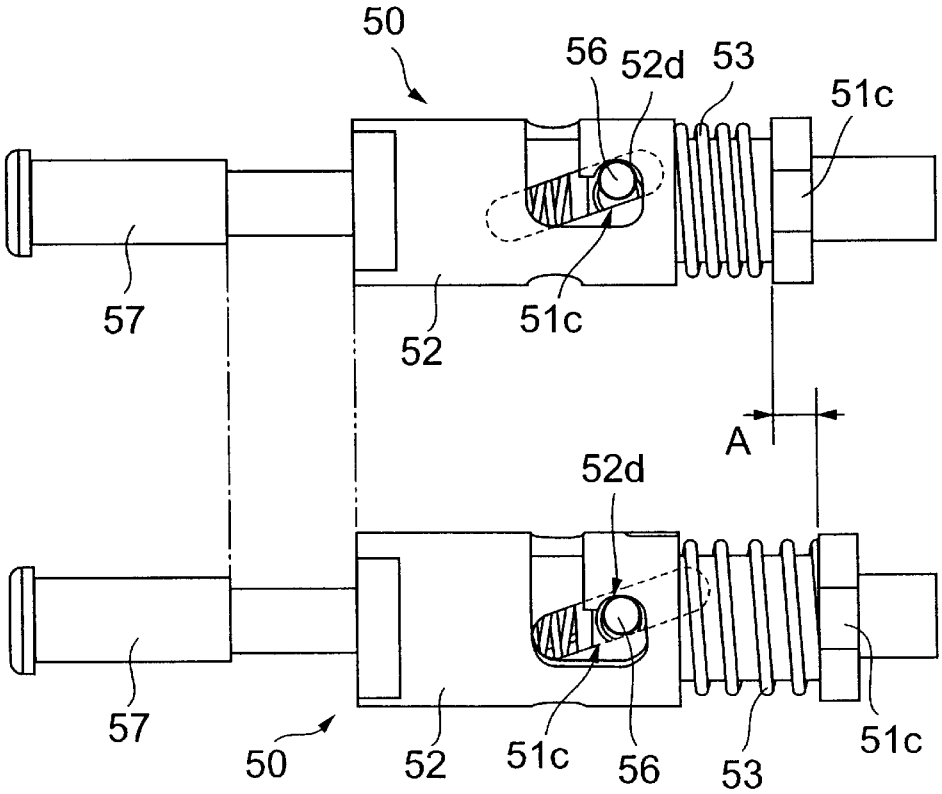
FIG. 9 is a side view for explaining operational states of the pipe hinge unit according to Embodiment 1 of the invention.

Next, an explanation will be given of a mechanism of adjusting a wrapping angle according to the size of the arm. An explanation will be given of fine adjustment operation by the pipe hinge unit 50 described above. As shown by FIG. 5 and FIG. 9, there is provided a gap A between the slide pipe 51 and the case main body 10 (also between the slide pipe 51 and the rotational pipe 52) and the gap can be elongated and contracted in the left and right direction by the unit fixing screw (fine adjustment screw) 57. Further, since the fixed pin slide hole 51*a* of the slide pipe 51 is provided with a twisted shape and accordingly, by elongating or contracting the unit fixing screw 57, as shown by FIG. 9, the position of the fixed pin regulating face 51*e* for sandwiching the fixed pin 56 is changed in the rotational direction. Thereby, the position of the fixed pin settling stepped portion 52*d* fitted with the fixed pin 56 relative to the fixed pin slide hole 51*a*, is also changed and by changing a position of locking the strap in accordance with a pitch of the fixed pin slide hole 51*a*, a set position of the arm of respective person can be determined.

According to the above-described embodiment, there are provided the pipe hinge units at hinge portions of the case and the straps and therefore, there is achieved an effect that the straps of the bangle type can be opened and closed by one touch operation, further, the straps are fitted to the arm of respective person in steps. Further, between two pairs of the pipes rotated coaxially, the fixed pins are fitted to the fixed pin settling stepped portions and therefore, firm locking can be carried out. Therefore, the strap can be opened and closed instantaneously relative to the arm and can be fitted to the arm of respective person at a stable position and therefore, particularly, there is achieved further excellent effect when the strap is used in a PHS communication terminal of a wrist watch type which needs to attach and detach frequently.

(Embodiment 2)

Figure 10:
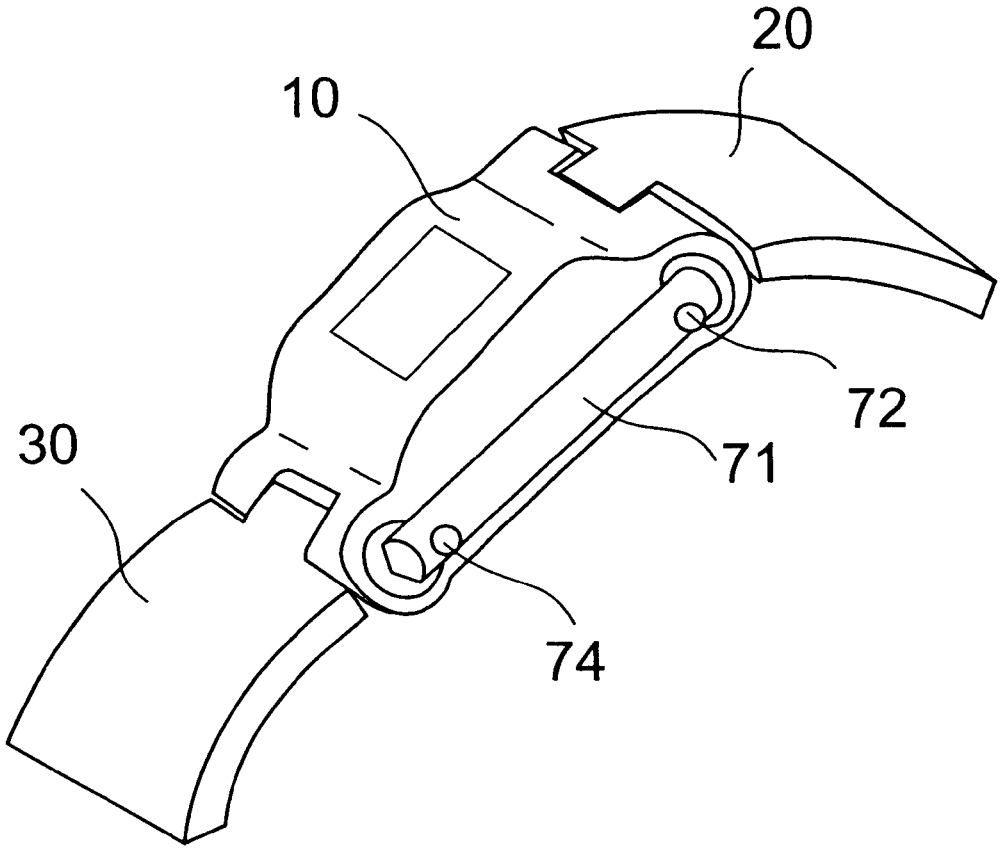
FIG. 10 is a perspective view for explaining a wrist watch type PHS communication terminal according to Embodiment 2 of the invention.
Figure 11:
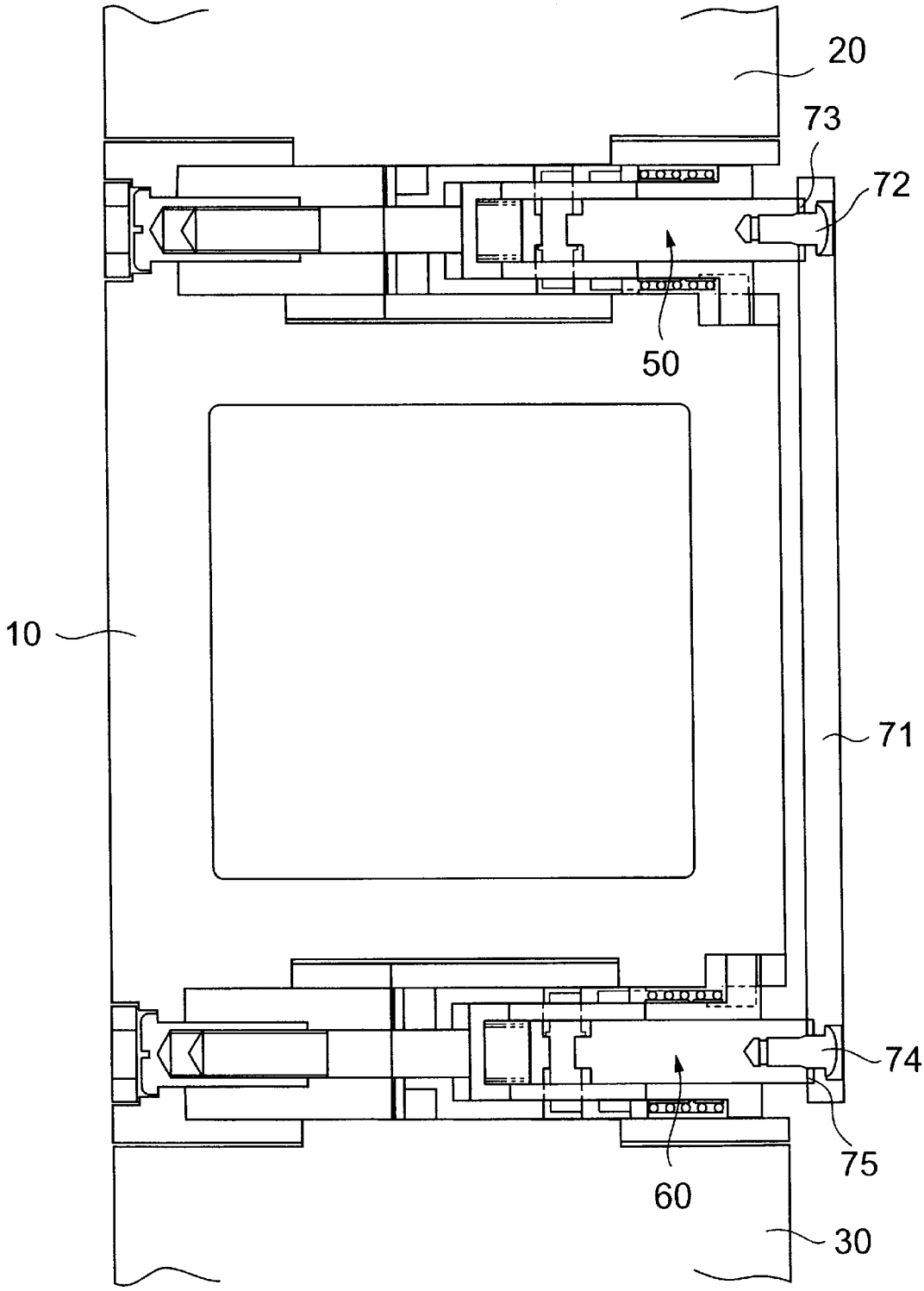
FIG. 11 is a partially cut sectional view of the wrist watch type PHS communication terminal according to Embodiment 2 of the invention.

FIG. 10 is a perspective view for explaining a wrist watch type PHS communication terminal according to Embodiment 2 of the invention. FIG. 11 is a partially cut sectional view of the wrist watch type PHS communication terminal according to Embodiment 2 of the invention. Embodiment 2 is constituted by adding the constitution of Embodiment 1 with a button bar 71, striking pins 72 and 74 and a sliding washer 73 shown below. That is, when the buttons of the hinge units 50 and 60 on the 12 o'clock side and the 6 o'clock side are bridged by the button bar 71 and the striking pines 72 ad 74, the strap pieces 20 and 30 can simultaneously be opened by one touch operation.

Further, the sliding washers 73 and 75 fix the button bars 71 when the buttons of the hinge units 50 and 60 are rotated by a strap opening angle and operate to help rotate the buttons 50 and 60 and the button bar 71.

Further, although according to the above-described embodiments, an explanation has been given by taking an example of the mounting strap used for the PHS communication terminal of the wrist watch type communication apparatus, the mounting strap can similarly be constituted and operated also for other portable apparatus such as other wrist watch type communication apparatus, wrist watch, wrist watch type information apparatus or the like.

Further, in the foregoing embodiments, an explanation has been given of the case in which the 10 o'clock side strap 20 and the 6 o'clock side strap 30 are urged in the opening direction, maintain the closed state and release the closed state. In an alternative embodiment, the straps are urged in the closing direction, maintain the opened state and release the opened state. Thus, a portable terminal can be mounted to the arm easily by one touch operation. In this case, the above-described pipe hinge unit is attached by changing the direction by 180 degrees to invert the rotational direction.

As has been explained above, according to the hinge unit of the mounting strap of the invention, there is achieved an effect in which by axially fixing the strap pieces rotatably to the one end side or the other end side of the case main body, a user can detach or mount the mounting strap from and to the arm by operation of pushing the button member. Further, there is achieved an effect of capable of providing inexpensively the mounting strap having high general purpose performance for a maker thereof. Particularly, in the case of a portable apparatus of an arm mounting type such as a PHS communication terminal which needs to fit to the arm to ensure the operability, there can be promoted attaching and detaching operability when the portable apparatus is operated by attaching and detaching thereof to and from the arm in a hurry.

What is claimed is:

1. A hinge assembly comprising: a tubular member having a longitudinal axis, a peripheral surface, and a slot formed in the peripheral surface; a button member extending into the tubular member to undergo sliding movement in an axial direction along the longitudinal axis of the tubular member and to undergo rotational movement relative to the tubular member; a pin member connected to the button member and extending into the slot of the tubular member to undergo movement therein during sliding and rotational movement of the button member relative to the tubular member; a first biasing member for biasing the button member in a preselected direction of rotation relative to the tubular member; and a second biasing member for biasing the button member in the axial direction.

2. A hinge assembly according to claim 1; wherein the slot is generally L-shaped.

3. A hinge assembly according to claim 1; wherein the slot has a first section within which the pin member undergoes movement during rotational movement of the button member relative to the tubular member, and a second section within which the pin member undergoes movement during sliding movement of the button member in the axial direction.

4. A hinge assembly according to claim 3; wherein the second section of the slot extends circumferentially in opposite direction from the first section of the slot.

5. A hinge assembly comprising: a first tubular member having a longitudinal axis, a peripheral surface, and a slot formed in the peripheral surface; a second tubular member extending into the first tubular member so that the first tubular member is capable of undergoing rotational movement relative to the second tubular member, the second tubular member having a longitudinal axis, a peripheral surface, and a slot formed in the peripheral surface thereof; a button member extending into the second tubular member for undergoing sliding movement in an axial direction along the longitudinal axis of the second tubular member; a pin member connected to the button member and extending through the slot of the first tubular member and into the slot of the second tubular member for undergoing movement in each of the slots during rotational movement of the first tubular member and sliding movement of the button member; a first biasing member for biasing the first tubular member in a preselected direction of rotation relative to the second tubular member; and a second biasing member for biasing the button member in the axial direction.

6. A hinge assembly according to claim 5; wherein the slot of the second tubular member extends in a direction transverse to the longitudinal axis of the second tubular member.

7. A hinge assembly according to claim 5; wherein the first biasing member has a first terminal end portion connected to the first tubular member and a second terminal end portion connected to the second tubular member.

8. A hinge assembly according to claim 5; wherein the slot of the first tubular member is generally L-shaped.

9. A hinge assembly according to claim 5; wherein the slot of the first tubular member has a first section within which the pin member undergoes movement during rotational movement of first tubular member and a second section within which the pin member undergoes movement during sliding movement of the button member.

10. A hinge assembly according to claim 9; wherein the second section of the slot extends circumferentially in opposite direction from the first section of the slot.

11. A hinge assembly according to claim 9; wherein the second section of the slot extends in the axial direction of the first tubular member.

12. A hinge assembly for rotationally mounting a rotational member to a body member, the hinge assembly comprising: a first tubular member to be secured to a rotational member, the first tubular member having a longitudinal axis, a peripheral surface, and a slot formed in the peripheral surface; a second tubular member to be secured to a body member, the second tubular member extending into the first tubular member so that the first tubular member is capable of undergoing rotational movement relative to the second tubular member, the second tubular member having a longitudinal axis, a peripheral surface, and a slot formed in the peripheral surface thereof; a button member extending into the second tubular member for undergoing sliding movement in an axial direction along the longitudinal axis of the second tubular member; a pin member connected to the button member and extending through the slot of the first tubular member and into the slot of the second tubular member for undergoing movement in each of the slots during rotational movement of the first tubular member and sliding movement of the button member; a first biasing member for biasing the first tubular member in a preselected direction of rotation relative to the second tubular member; and a second biasing member for biasing the button member in the axial direction.

13. A hinge assembly according to claim 12; wherein the slot of the second tubular member extends in a direction transverse to the longitudinal axis of the second tubular member.

14. A hinge assembly according to claim 12; wherein the first biasing member has a first terminal end portion connected to the first tubular member and a second terminal end portion connected to the second tubular member.

15. A hinge assembly according to claim 12; wherein the body member is a main body of a portable information apparatus and the rotational member is a strap member for mounting the main body to an arm of a user; and wherein the strap member undergoes movement between an open state and a closed state relative to the main body during movement of the pin member in the slots of the first and second tubular members.

16. A hinge assembly according to claim 15; wherein the slot of the first tubular member is generally L-shaped.

17. A hinge assembly according to claim 15; wherein the slot of the first-tubular member has a first section within which the pin member undergoes movement during rotational movement of first tubular member and a second section within which the pin member undergoes movement during sliding movement of the button member in the axial direction; and wherein the pin member abuts a terminal end of the second slot section when the strap member is in the closed state.

18. A hinge assembly according to claim 17; wherein the second section of the slot extends circumferentially in opposite direction from the first section of the slot.

19. A hinge assembly according to claim 17; wherein the second section of the slot extends in the axial direction of the first tubular member.

20. In combination with a portable communication apparatus having a main body and a pair of strap members for mounting the main body to an arm of a user, a hinge assembly comprising: a pair of hinge units each for rotationally mounting respective ones of the strap members to the main body, each of the hinge units having a first tubular member connected to a respective one of the straps and having a slot formed in a peripheral surface thereof, a second tubular member connected to the main body and having a portion extending into the first tubular member so that the first tubular member is capable of undergoing rotational movement relative to the second tubular member, a button member having a portion extending into the second tubular member for undergoing sliding movement therein in an axial direction along a longitudinal axis of the second tubular member, a pin member connected to the button member and extending through the slot of the first tubular member for undergoing movement in the slot during rotational movement of the first tubular member and sliding movement of the button member so that the respective strap member undergoes movement between an open state and a closed state relative to the main body, a first biasing member for biasing the first tubular member in a preselected direction of rotation relative to the second tubular member, and a second biasing member for biasing the button member in the axial direction.

21. A combination according to claim 20; wherein the slot of the first tubular member is generally L-shaped.

22. A combination according to claim 20; wherein the slot of the first tubular member has a first section within which the pin member undergoes movement during rotational movement of first tubular member and a second section within which the pin member undergoes movement during sliding movement of the button member in the axial direction; and wherein the pin member abuts a terminal end of the second slot section when the strap member is in the closed state.

23. A combination according to claim 22; wherein the second section of the slot extends circumferentially in opposite direction from the first section of the slot.

24. A combination according to claim 23; wherein the second section of the slot extends in the axial direction.

25. A combination according to claim 22; wherein the second section of the slot extends in the axial direction.

26. A combination according to claim 20; wherein the second tubular member has a slot formed in a peripheral surface thereof; and wherein the pin member extends through the slot of the second tubular member.

27. A combination according to claim 20; further comprising a bar member connecting the button members of the hinge units to one another.

* * * * *